United States Patent [19]

Curtiss

[11] 3,930,764

[45] Jan. 6, 1976

[54] AIR TOOL OVERSPEED SHUTOFF DEVICE

[75] Inventor: George R. Curtiss, Chardon, Ohio

[73] Assignee: Cooper Industries, Inc., Houston, Tex.

[22] Filed: Dec. 26, 1974

[21] Appl. No.: 536,388

[52] U.S. Cl. ..... 418/43; 137/57

[51] Int. Cl.[2] ..... F01C 21/12; G05D 13/10

[58] Field of Search ..... 418/40–44; 137/57

[56] References Cited

UNITED STATES PATENTS

| | | | |
|---|---|---|---|
| 2,586,968 | 2/1952 | Maclay | 418/43 |
| 3,257,913 | 6/1966 | Broom et al. | 418/43 |
| 3,279,485 | 10/1966 | Alexander | 418/43 |
| 3,749,530 | 7/1973 | Amador | 418/41 |

*Primary Examiner*—John J. Vrablik

*Attorney, Agent, or Firm*—Vincent L. Barker, Jr.; Thomas M. Freiburger

[57] ABSTRACT

An overspeed shutoff device for use in a rotary pneumatic tool is disclosed. The device is operable to shut off air supply to the motor on failure of its governor to function properly in preventing overspeeding of the motor. The device includes a valve closing plate positioned in the path of air flow to the pneumatic motor, just upstream of an inlet port for passage of air into the motor. In normal operation of the tool the valve plate, which rotates with the motor drive shaft, is retained in a position spaced from the air inlet port by a locking mechanism engaging the drive shaft of the tool to prevent axial movement therealong. The plate locking device comprises a cantilever mounted spring wire in engagement with a groove in the drive shaft and a centrifugally responsive weight operably connected to disengage the wire from the groove in response to the attainment of a predetermined rotary speed. Upon failure of the main governor of the tool and consequent acceleration of the motor to such predetermined speed, the wire is disengaged from the shaft groove and the air pressure drop across the valve inlet port causes the closure plate to move toward and cover the inlet port, thereby stopping the flow of air to the motor.

7 Claims, 5 Drawing Figures

AIR TOOL OVERSPEED SHUTOFF DEVICE

BACKGROUND OF THE INVENTION

The invention relates to rotary pneumatic tools, and more particularly to such tools which employ a governor to control the speed of the motor.

In rotary pneumatic tools, it is desirable to prevent overspeeding of the motor, particularly when the tool is used to rotate a grinding wheel. The operating speed of such a tool is generally controlled by a centrifugally operated governor which throttles down the flow of air to the motor in response to the attainment of a specified operating speed. This main governor can malfunction for a variety of reasons, including the presence of wear, dirt, rust, air line moisture which may condense and freeze in the tool, or improper lubrication of the tool. Such malfunctions prevent the desired speed control, so that the tool can quickly exceed the safe speed of rotation of a grinding wheel. The resulting centrifugal force will cause the grinding wheel to disintegrate, posing a danger of serious injury and damage.

To prevent the overspeeding of such rotary pneumatic tools, various overspeed regulators and shutoff devices have been suggested. See, for example, U.S. Pat. Nos. 2,422,733, 2,586,968, 3,002,495, 3,043,273, 3,071,115, 3,257,913, 3,279,485, 3,519,372, 3,587,752 and 3,749,530. In operation, the overspeed devices generally rotate with the motor shaft and are activated in response to centrifugal forces above those associated with the intended operating speed of the tool. The overspeed devices generally shut off air supply to the motor, stopping the tool, and are often designed to remain in the shutoff position until the tool is dismantled to enable resetting of the device. In this way, repair of the defect which caused malfunction of the tool's speed governor is encouraged.

The tools referenced above utilize various structural arrangements to accomplish their common objective. In some of the arrangements certain shortcomings are inherent. For example, in devices which utilize a "frictionless" type movement of the overspeed device (comprising a deflectable spring washer) into the shutoff position, problems are inherent with the manner in which the device is rotatably driven. The frictional engagement of an annular rubber grommet is depended upon to drive such a device. Deterioration of the grommet can result in failure of the overspeed device to rotate at motor speed and consequently to prevent overspeeding of the tool. Also, virtually all of the referenced devices are unprotected from contaminants such as hose residue, pipe scale and other foreign material which can cause malfunction of the overspeed device as well as of the operating speed governor.

SUMMARY OF THE INVENTION

The present invention provides a simple and effective overspeed safety device for shutting off a rotary pneumatic tool in response to the rotation of the tool at speeds above designed level. The overspeed shutoff of the invention includes a valve closure plate mounted for rotation with the motor shaft and positioned in the path of air flow to the motor just upstream of an air inlet port to the motor. If the operating governor of the tool fails to function and the motor reaches a predetermined speed in excess of the design speed, the valve closure plate is released from its normal position along the shaft and moved axially under the influence of air pressure to cover the air inlet port and stop the flow of air to the motor. The closure plate remains in the shutoff position until the tool is dismantled and the closure plate mechanism is reset.

The mechanism employed to regulate the closure of the valve plate includes a housing connected to the plate and forming a chamber, and a cantilevered spring wire or rod extending through the central area of the chamber, engaged under normal operation in a groove formed on the rotary shaft of the tool. To bias the spring wire toward the groove, the wire is flexed by means of its cantilever mounting into engagement with the groove. The wire includes a bend, so that a portion of the wire beyond the shaft extends generally radially with respect to the center of the shaft. On this portion of the shaft is a slidable weight which normally resides in a pocket defined in a portion of the housing. The weight is urged by a compression spring, also on the wire, toward the bend, which defines the zero position of the weight. During the rapid acceleration of the tool to normal operating speed, which may occur in only two revolutions, the pocket confines the movement of the weight to a radial path. This prevents the weight's inertia from causing it to move circumferentially opposite the direction of rotation of the overspeed device, which would pull the wire out of the shaft groove prematurely. When the tool reaches its design operating speed, the weight has moved out of the pocket against the bias of the compression spring, and it remains directly above the pocket due to the flexure bias on the wire.

In response to the attainment of a predetermined level of motor speed above the normal operating level, on malfunction of the operating governor of the tool, the increased centrifugal force on the weight causes it to move circumferentially as well as radially. The compression spring is fully compressed at this point so that in order to further move radially, the weight must move circumferentially as well as radially. This movement acts to pull outwardly on the wire. Since the wire includes a bend, the outward pulling force is effective to pull the portion of the wire adjacent the shaft out of the groove of the shaft, against the bias force on that portion of the wire. This allows the valve closure plate and housing to move toward the air inlet ports in response to a pressure difference on either side of the plate.

At the end of the wire opposite the end on which the weight is slidable, the wire is connected to the housing on a cantilevered pivotal mount. A screw is provided to adjust the rotational position of the mount, thereby introducing the bias force of the wire against the shaft groove prior to assembly of the overspeed device into the tool.

The air tool overspeed safety shutoff of the invention is advantageous in that it is not subject to wear in normal operation, it is easily adjusted to provide for the desired shutoff speed, and it is relatively simple, free of the complexities of prior devices. In addition, the operating mechanism of the overspeed device is completely enclosed to prevent contamination and malfunction. The device is virtually fail-safe, since if a premature deployment would occur, the tool would simply shut off. The position of the rotating components of the shutoff device, adjacent the tool's main bearing, also adds to reliability of the tool by minimizing overhung load and chance of metal fatigue. After activation of the shutoff device of the invention, the tool cannot be restarted until it is dismantled, at which time the defective speed governor of the tool can be inspected and repaired.

DESCRIPTION OF THE PREFERRED EMBODIMENT

Figure 1:
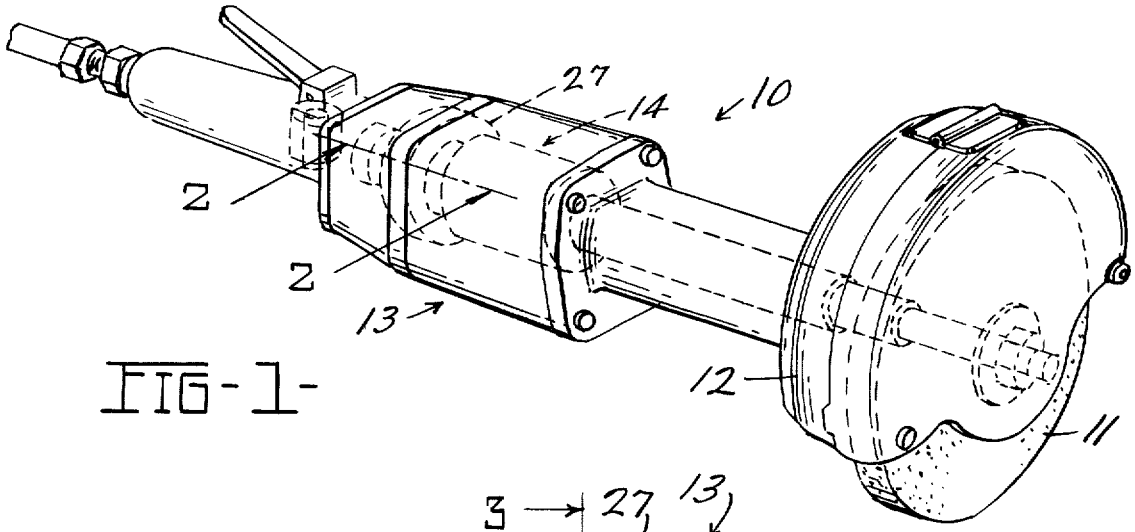
FIG. 1 is a perspective view of a rotary pneumatic grinder incorporating the overspeed safety device of the invention.

FIG. 1 shows a horizontal type portable rotary pneumatic grinder 10 including a grinding wheel 11, a grinder guard 12 and a motor compartment 13. The grinding tool 10 is an example of the type of pneumatic tool in which the overspeed shutoff device of the invention may be included.

Figure 2:
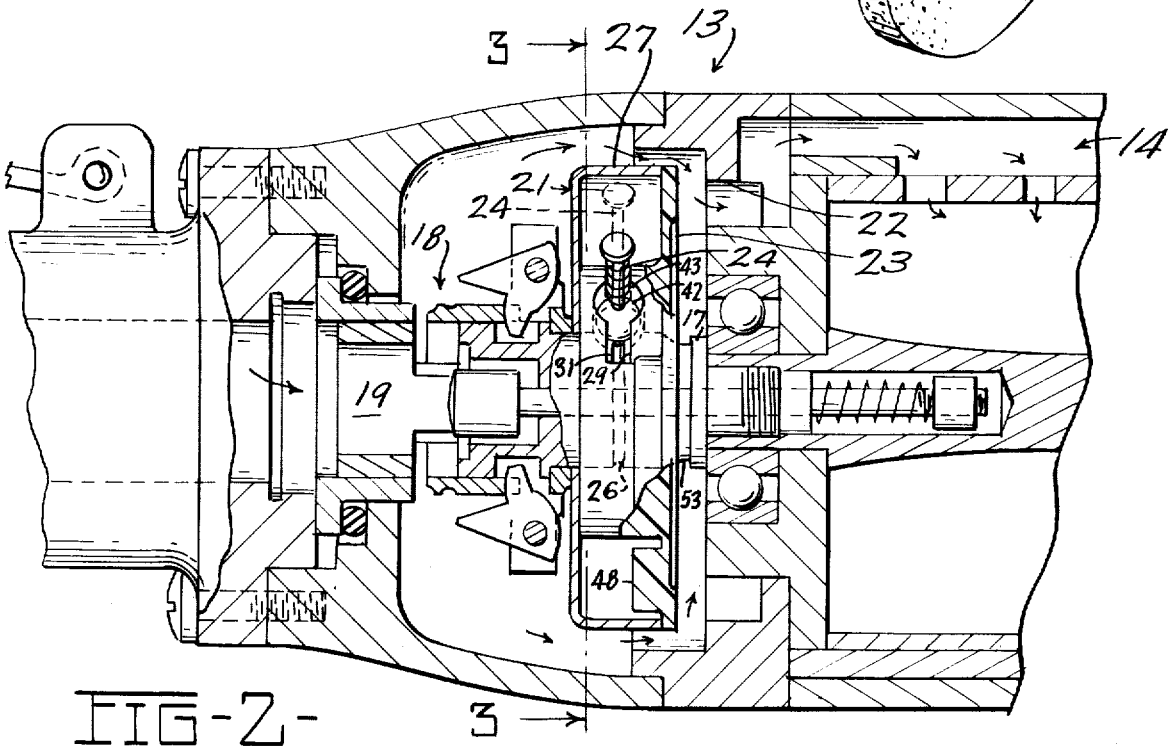
FIG. 2 is a sectional view of the tool showing the overspeed device in the normal operating position.

FIG. 2 is a sectional view through the motor compartment 13 showing a portion of a pneumatic motor 14, a motor shaft extension 17 which is rotatable with the motor 14, an operating speed governor 18 of the sleeve type on the shaft 17, operable to regulate the flow of air through an inlet port 19 en route to the motor 14, and an overspeed safety shutoff 21 according to the invention. Although a sleeve type main governor 18 is shown in FIG. 2, a proximity or other type governor (not shown) can also be used in an air tool in conjunction with the safety overspeed device 21.

As FIG. 2 shows, the safety overspeed device 21 under normal operating conditions is positioned just upstream of an air inlet port 22 which admits working air to the motor 14. A small pressure drop exists from the upstream side of the device 21 to the downstream side adjacent the inlet port 22. The pressure drop may be, for example, about three p.s.i. A valve closure plate 23 forming the downstream side of the shutoff device 21 is adapted to close off the air inlet port 22, thereby shutting off the tool 10, in the event that the shutoff device 21 is allowed to move axially downstream along the shaft 17 under the influence of the pressure drop. To prevent the shutoff assembly 21 from moving axially toward the shutoff position in normal operation, the assembly includes a rod or spring wire 24 which normally engages a groove 26 of the shaft 17. To this end, the shutoff assembly 21 includes a housing 27 and an inner hub portion 28 connected to the closure plate 23 and supporting the spring wire 24.

Figure 3:
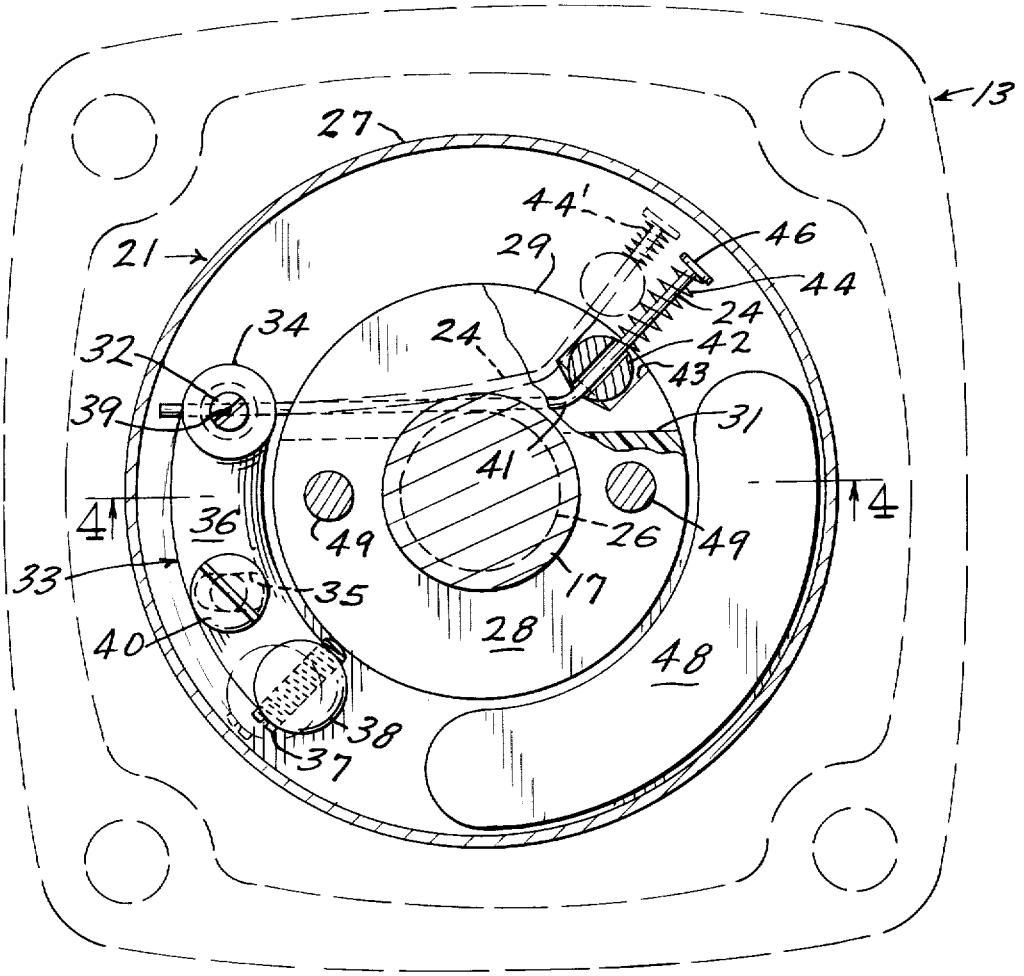
FIG. 3 is a sectional view taken along the line 3—3 of FIG. 2.

The structure of the shutoff assembly 21 is best seen in FIG. 3. The housing 27, closure plate 23 and hub portion 28 of the assembly 21 are preferably made of a high strength lightweight material such as "Lexan", a polycarbonate resin manufactured by General Electric Company, Pittsfield, Massachusetts. The use of such lightweight material aids in dynamic balancing of the assembly 21, reduction of total tool weight, and prevention of wear on the closure plate 23 and air inlet port 22, as will be seen below. The weight of the assembly 21 may be, for example, approximately one ounce.

The complete spring wire assembly is preferably enclosed within the housing 27 and closure plate 23, with the shaft 17 forming an inner closure boundary. This enclosure prevents contamination by foreign particles which might cause malfunction of the assembly. The spring wire 24 passes through the hub portion 28 transversely to the shaft 17, thereby engaging the groove 26. The hub portion 28 has a slot 29 defined for the spring wire 24, the bottom 31 of the slot being shown in FIG. 3. The slot 29, more clearly shown in FIG. 2, provides the spring wire 24 access for flexing in and out of the shaft groove 26, as will be seen below.

The spring wire 24 is held in place by a wire mount assembly 33 shown in FIG. 3. The mounting assembly 33 includes a sleeve 34 through which the spring wire 24 passes radially to provide a cantilevered mount, an arcuate adjusting plate 36 to which the sleeve 34 is affixed, and an adjusting screw 37 threaded through a nut member 38 connected to the end of the adjusting plate opposite the sleeve 34. The plate 36, preferably of lightweight synthetic material, is rotatably fastened to the housing 27 at a pivot point 39 by any suitable connection which affords rotation about the center of the mounting sleeve 34. A set screw 32, seated in the sleeve 34, may be provided to lock the spring wire 24 in place. When the adjustment screw 37 is rotated, that end of the adjustment plate 38 is moved toward or away from the outer surface of the hub portion 28, thereby rotating the adjustment plate about the point 39. This rotation adjusts the amount of flexure force that the cantilevered spring wire 24 exerts against the shaft groove 26. Rotation of the screw 37 in one direction will increase the bias force of the spring wire 24 against the shaft groove 26, while rotation in the opposite direction will lessen the bias force. As will be seen below, this adjustment regulates the speed at which centrifugal force acts to pull the spring wire 24 out of the groove 26.

The wire mounting assembly 33 also includes a locking fastener 40 passing through a slotted opening 35 in the plate 36 and through a portion of the housing 27. When the adjustment screw 37 has been properly set for the desired safety shutoff speed, the fastener 40 is tightened. The mounting plate 36 may also be affixed to the housing 27 by solvent welding. After the mounting assembly 33 has been properly set, the housing 27 is closed and sealed to prevent the intrusion of dirt or other contaminating matter.

At the end of the spring wire 24 opposite the spring mount assembly 33 is a bend 41, above which is a slidable weight 42 through which the wire 24 passes. The weight 42 may comprise, for example, a steel ball with a diametric hole drilled therethrough. The weight 42 normally resides in a bore or pocket 43 extending inward from the outer cylindrical surface of the hub portion 28 and straddling either side of the hub slot 29. To bias the weight toward the pocket 43, a compression coil spring 44 is positioned on the wire between the weight 42 and a head 46 affixed to the end of the wire 24.

As the weight 42 moves outwardly along the spring wire 24 against the bias of the compression spring 44, under the influence of centrifugal force associated with rotational speed of the shutoff assembly 21, initial rapid acceleration of the motor tends to drag the weight in the opposite rotational direction from that of the tool, tending to pull the wire out of the groove. The radially oriented pocket 43 keeps the weight 42 in a radial path of movement until operating speed is reached and acceleration is terminated. At this point, the weight is outside the confines of the pocket 43, where it resides at the tool's operating speed. The flexure bias of the spring wire toward the groove 26 prevents further movement of the weight at operating speed. Under these conditions, the compression spring 44 is preferably fully compressed, although a stiffer spring can be provided which would not be fully compressed.

If the tool's governor 18 fails, the tool will tend to overspeed. This increases the centrifugal force on the weight 42, further pushing radially outwardly on the head 46 of the spring wire 24, thereby further pulling on the remainder of the spring wire below the bend 41. A component of the force exerted on the lower portion of the spring wire 24 by the weight 42 is in a direction away from the normal position of that portion of the wire 24 within the shaft groove 26. In order to move farther outward, the weight 42 must also move in a circumferential direction (counterclockwise in FIG. 3). Therefore, when sufficient speed is developed, the weight 42 will pull the spring wire 24 out of the shaft groove 26. The speed at which this occurs depends upon the bias force of the spring wire 24 against the shaft groove 26, which is determined by the position of the adjustment screw 37. Displacement of the wire from the groove releases the shutoff assembly 21 from its normal position spaced from the air inlet port 22, allowing the pressure differential across the assembly 21 to move the assembly toward the inlet port 22.

It should be understood that since the direction of rotation of the overspeed shutoff assembly is clockwise in FIG. 3, the effect of overspeed acceleration aids in releasing the assembly 21 from the shaft groove 26. Such acceleration causes the weight to pull in a counterclockwise direction with respect to the assembly 21, thereby tending, along with centrifugal force, to pull the wire 24 out of the groove 26.

As shown in FIG. 2, a counterweight 48 is provided at an appropriate location on the safety shutoff assembly 21 for balancing the assembly 21 against the effects of the weight 42, the spring wire 24, the pocket 43, the compression spring 44 and the mounting assembly 33. The assembly 21 is balanced so that its center of gravity is at the center of the shaft 17 when the weight 42 is in the normal operating position just above the pocket 43.

Figure 4:
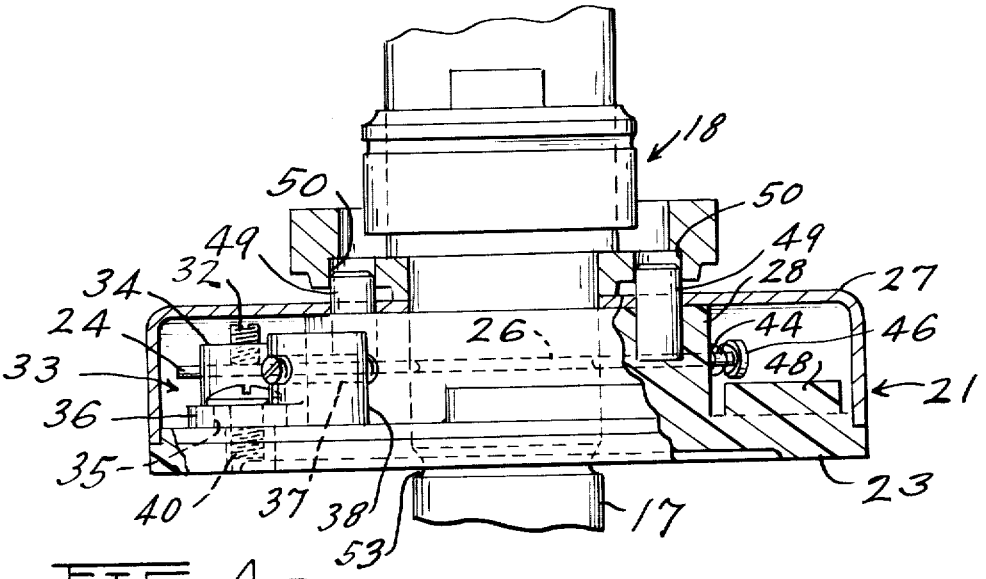
FIG. 4 is a sectional view taken along the line 4—4 of FIG. 3.

As shown in FIGS. 3 and 4, a pair of drive pins 49 are provided to key the safety overspeed assembly 21 into the governor 18 so that the assembly 21 rotates along with the governor 18 and the motor shaft 17 in normal operation. The guide pins 49 are rigidly connected to the assembly 21 and normally are engaged by bores 50 in a portion of the governor 18, in which the pins are slidable. When the assembly 21 is released by overspeeding and moves along the shaft 17 toward the air inlet port 22, the pins 49 slip out of driving engagement with the governor 18, allowing the assembly 21 to rotate freely under its own inertia. Thus, the lightweight assembly 21 quickly comes to rest on engaging the inlet port 22, preventing significant wear.

When the assembly 21 has decelerated below the overspeed level, the weight 42 is urged back toward the pocket 43 by the flexed spring wire 24. At this point, the wire 24 is not over the groove 26, so that the shaft 17 prevents it from fully returning to its original position.

Figure 5:
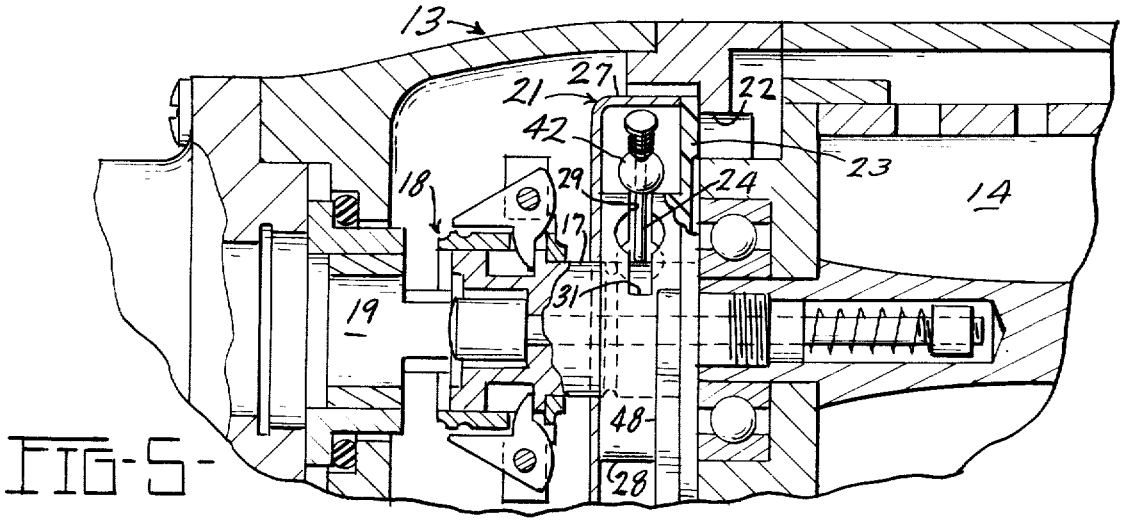
FIG. 5 is a sectional view showing the safety overspeed device in the shutoff position.

As shown in FIGS. 2, 4 and 5, a second groove 53 is provided in the motor shaft extension 17, downstream and spaced from the groove 26. The groove 53 is shaped in such a way to prevent unauthorized removal of the safety governor device 21 when the tool is dismantled, as shown in FIG. 2. Thus, with the spring wire 24 in its disengaged position biased against the shaft 17, an operator or serviceman would not succeed in sliding the assembly past this second groove 53. The spring wire 24 would become firmly locked in position in the groove 53. The shape of the groove 53 allows the governor assembly 21 to slide into the assembled position on the shaft 17 when the tool is first assembled or when the overspeed assembly 21 is reset.

In operation of the air tool 13 including the overspeed safety device 21, the tool in normal operation is controlled by the main governor 18 to rotate at a predetermined operating speed which may be, for example, 6000 r.p.m. If the operating governor 18 malfunctions, failing to properly throttle air flow to the motor 14, the tool will overspeed, exceeding 6000 r.p.m. When a second predetermined speed level is reached, which may be, for example, about 7000 r.p.m., the safety overspeed governor 21 will be activated. The weight 42 will be urged by increased centrifugal force to further move radially outwardly, thereby pulling the spring wire 24 out of the shaft groove 26 as described above. At that instant, the overspeed device 21 will begin sliding axially downstream along the motor shaft 17 under the influence of the pressure drop between the upstream and downstream sides of the device 21. As the valve closure plate 23 moves toward the air inlet 22, the pressure drop across the device 21 increases, so that the air inlet 22 is snapped closed by quickly accelerating movement of the assembly 21. The rotation of the assembly 21 is instantly stopped upon engagement with the air inlet port 22, since it is no longer driven by the shaft 17 and because of its low mass. As discussed above, after the safety overspeed device 21 has shut the tool off, the spring wire 24 cannot be re-engaged in the shaft groove 26 without dismantling of the tool.

The shutoff of the tool 10 and its inability to restart indicate the malfunction of the speed governor 18. An operator is unable to reset the overspeed assembly 21 in the assembled tool 10 after it has been activated, so that the tool must be dismantled to correct the condition. When the governor 18 has been repaired, cleaned or replaced, the safety overspeed device 21 can be reset on the shaft 17 by aligning the drive pins with the bores 50 and sliding the assembly 21 up the shaft to snap it into place in the shaft groove 26.

The above described preferred embodiment provides an air tool overspeed shutoff device which is dependable, inexpensive to manufacture and substantially tamper-proof. Numerous other embodiments and alterations to the preferred embodiment will be apparent to those skilled in the art and may be made without departing from the spirit and scope of the following claims.

I claim:

1. In a rotary tool having a pneumatic motor, a rotary shaft connected to the motor, means defining a first inlet port through which pressurized air is supplied to drive the motor, a centrifugally operated rotatably driven governor including a valve cooperating with said first port to control the flow of air through said first port in relation to the rotational speed of said governor, and means defining a second inlet port, downstream of said governor, through which pressurized air from the first port travels to the motor, the improvement of a safety overspeed device operable to shut off the motor in response to a predetermined motor speed level, comprising valve closure means for engaging and closing the second inlet port, said closure means being slidably mounted for axial movement on the shaft and spaced from the second inlet port in normal operation, means connected to the shaft for rotating said closure means in its normal operating position, and means responsive to centrifugal force associated with a predetermined motor speed for moving said closure means toward and into engagement with the second inlet port.

2. The apparatus of claim 1 wherein said rotating means further includes means for releasing the closure means from rotation with the shaft in response to axial translation of the closure means toward the inlet port.

3. In a rotary tool having a pneumatic motor, a rotary shaft connected to the motor, means defining a first inlet port through which pressurized air is supplied to drive the motor, a centrifugally operated rotatably driven governor incuding a valve cooperating with said first port to control the flow of air through said first port in relation to the rotational speed of said governor, and means defining a second inlet port, downstream of said governor, through which pressurized air from the first port travels to the motor, the improvement of a safety overspeed device operable to shut off the motor in response to a predetermined motor speed level, comprising a valve closure means in the path of airflow upstream of said second inlet port for engaging and closing the second inlet port, said closure means being slidably mounted on the shaft for axial movement with respect thereto and positioned in spaced, upstream relationship to the second inlet port in normal operation, means connected to the shaft for rotating the closure means in its normal operating position and for releasing the closure means from rotation with the shaft in response to axial translation of the closure means toward the second air inlet port, means retaining the closure means in its position spaced from the second air inlet port in normal operation, and means responsive to centrifugal force associated with a predetermined motor speed for releasing said retaining means, whereby, when said predetermined motor speed is reached, said valve closure means is moved by a pressure differential between its upstream and downstream sides toward and into engagement with the second inlet port to shut off the motor.

4. In a rotary tool having a pneumatic motor, an inlet port through which pressurized air is supplied to drive the motor, and a rotary shaft connected to the motor, the improvement of a safety overspeed device operable to shut off the motor in response to a predetermined motor speed level, comprising a valve closure means for engaging and closing the inlet port, said closure means being slidably mounted for axial movement on said shaft and positioned in spaced relationship from the inlet port in normal operation, means connected to the shaft for rotating the valve closure means in its normal operating position, means axially urging the valve closure means toward the inlet port, a groove extending in a circumferential direction in the shaft, a wire extending transversely to the shaft and operable to engage said groove and retain the valve closure means in its position spaced from the inlet port, means affixing one end of the wire to the valve closure means, means biasing the wire toward the groove, and means responsive to centrifugal force associated with a predetermined motor speed for pulling the wire out of the groove, whereby, when said predetermined motor speed is reached, said valve closure means is moved by said urging means toward and into engagement with the inlet port to shut off the motor.

5. The apparatus of claim 1 wherein said urging means comprises the positioning of the valve closure means in the path of airflow upstream of the inlet port, whereby, when said predetermined motor speed is reached, the valve closure means is moved by a pressure differential between its upstream and downstream sides toward the inlet port.

6. The apparatus of claim 1 wherein said centrifugal responsive means comprises a weight slidable along the wire toward the end of the wire opposite said one end, a bend in the wire between the shaft and the weight defining a generally radial orientation of said opposite end of the wire, and means biasing the weight radially inwardly on the wire, whereby, when centrifugal force associated with said predetermined motor speed acts on the weight, the weight is urged radially outwardly sufficiently to overcome the bias force on said spring wire, thereby translating the weight in a circumferential as well as a radial direction to pull the wire out of the groove in the shaft.

7. The apparatus of claim 6 wherein the direction of rotation of said overspeed device is opposite said circumferential direction of movement of the weight, and wherein said overspeed device further includes guide means for restricting the movement of the weight to a radial direction during an initial portion of the outward travel of the weight.

* * * * *

UNITED STATES PATENT OFFICE

CERTIFICATE OF CORRECTION

Patent No. 3,930,764 Dated January 6, 1976

Inventor(s) George R. Curtiss

It is certified that error appears in the above-identified patent and that said Letters Patent are hereby corrected as shown below:

In the claims:

Patent claim 5 should be dependent upon patent claim 4.

Patent claim 6 should be dependent upon patent claim 4.

Signed and Sealed this

*thirtieth* Day of *March 1976*

[SEAL]

*Attest:*

RUTH C. MASON
*Attesting Officer*

C. MARSHALL DANN
*Commissioner of Patents and Trademarks*